US012553680B2

(12) United States Patent
Lessard et al.

(10) Patent No.: US 12,553,680 B2
(45) Date of Patent: Feb. 17, 2026

(54) DYNAMICALLY BALANCED TRIGGER SYSTEM

(71) Applicant: Q, LLC, Dover, NH (US)

(72) Inventors: Ethan Lessard, Dover, NH (US); Nicholas Schafer, Northwood, NH (US)

(73) Assignee: Q, LLC, Dover, NH (US)

( * ) Notice: Subject to any disclaimer, the term of this patent is extended or adjusted under 35 U.S.C. 154(b) by 314 days.

(21) Appl. No.: 18/179,764

(22) Filed: Mar. 7, 2023

(65) Prior Publication Data

US 2023/0280120 A1 Sep. 7, 2023

Related U.S. Application Data

(60) Provisional application No. 63/317,288, filed on Mar. 7, 2022.

(51) Int. Cl.

| | |
|---|---|
| ***F41A 19/10*** | (2006.01) |
| ***F41A 19/12*** | (2006.01) |
| ***F41A 19/14*** | (2006.01) |
| ***F41A 19/31*** | (2006.01) |

(52) U.S. Cl.
CPC ..... *F41A 19/10* (2013.01); *F41A 19/12* (2013.01); *F41A 19/14* (2013.01); *F41A 19/31* (2013.01)

(58) Field of Classification Search
CPC combination set(s) only.
See application file for complete search history.

(56) References Cited

U.S. PATENT DOCUMENTS

| | | | | |
|---|---|---|---|---|
| 4,016,668 | A * | 4/1977 | Frazier | F41A 19/16 42/69.01 |
| 9,989,327 | B2 * | 6/2018 | Horch | F41A 19/10 |
| 10,006,734 | B1 * | 6/2018 | Findlay | F41A 19/12 |
| 2005/0235544 | A1 | 10/2005 | Bischoff | |
| 2015/0153125 | A1 | 6/2015 | Lutton et al. | |
| 2017/0160033 | A1 | 6/2017 | Schmid et al. | |
| 2018/0135929 | A1 | 5/2018 | Geissele | |
| 2018/0149441 | A1 | 5/2018 | Reynolds | |

OTHER PUBLICATIONS

International Search Report mailed Jun. 14, 2023 issued in International Application No. PCT/US2023/014731.
Written Opinion of the International Search Authority mailed Jun. 14, 2023 issued in International Application No.

* cited by examiner

*Primary Examiner* — Reginald S Tillman, Jr.
(74) *Attorney, Agent, or Firm* — Eversheds Sutherland (US) LLC

(57) ABSTRACT

A dynamically balanced trigger system for a firearm. The dynamically balanced trigger has a specific design, orientation, weights, and cutouts such as to provide a balanced trigger, where the chances of accidental discharge due to drops, shocks, and impacts are dramatically reduced. Unlike other triggers, the dynamically balanced trigger system has a trigger with a center of gravity near the center point of the trigger, which weights the trigger components against itself to prevent movement, such as may be caused by dropping the firearm, thereby helping prevent an unintentional discharge of the firearm.

24 Claims, 15 Drawing Sheets

DYNAMICALLY BALANCED TRIGGER SYSTEM

CROSS-REFERENCE TO RELATED APPLICATIONS

This application is related to, and claims the benefit of, U.S. Provisional Patent Application No. 63/317,288, filed Mar. 7, 2022, the entire contents of which are incorporated herein by reference.

TECHNICAL FIELD

The present application relates generally to a trigger system.

BACKGROUND

Trigger systems for rifles are typically comprise a trigger, disconnector, sear, and hammer, in addition to springs and other components that facilitate the operation of the trigger system. To simplify the installation and removal of trigger systems, it is known to assembly these parts in a housing, and then retain the housing within the receiver of a rifle using a hammer pin and trigger pin.

For many triggers, the design of the trigger and other components are such that during drop test and the like, the force of hitting the ground may cause movement of the trigger or disconnector, resulting in a negligent discharge of the firearm. Thus, it is desirable in the art to have a rifle trigger that decreases or eliminated negligent discharge in response to a blunt force (e.g., drop test), and mitigates trigger slap. Further, the geometry of the various components and how they interact with one another, tend to cause trigger slap, or the abrupt forcing of the trigger back into a forward (muzzle direction) movement of the trigger when the hammer is re-cocking.

BRIEF DESCRIPTION OF THE DRAWINGS

The detailed description is set forth with reference to the accompanying drawings. The drawings are provided for purposes of illustration only and merely depict example embodiments of the disclosure. The drawings are provided to facilitate understanding of the disclosure and shall not be deemed to limit the breadth, scope, or applicability of the disclosure. In the drawings, the left-most digit(s) of a reference numeral may identify the drawing in which the reference numeral first appears. The use of the same reference numerals indicates similar, but not necessarily the same or identical components. However, different reference numerals may be used to identify similar components as well. Various embodiments may utilize elements or components other than those illustrated in the drawings, and some elements and/or components may not be present in various embodiments. The use of singular terminology to describe a component or element may, depending on the context, encompass a plural number of such components or elements and vice versa.

DETAILED DESCRIPTION

Figure 1:
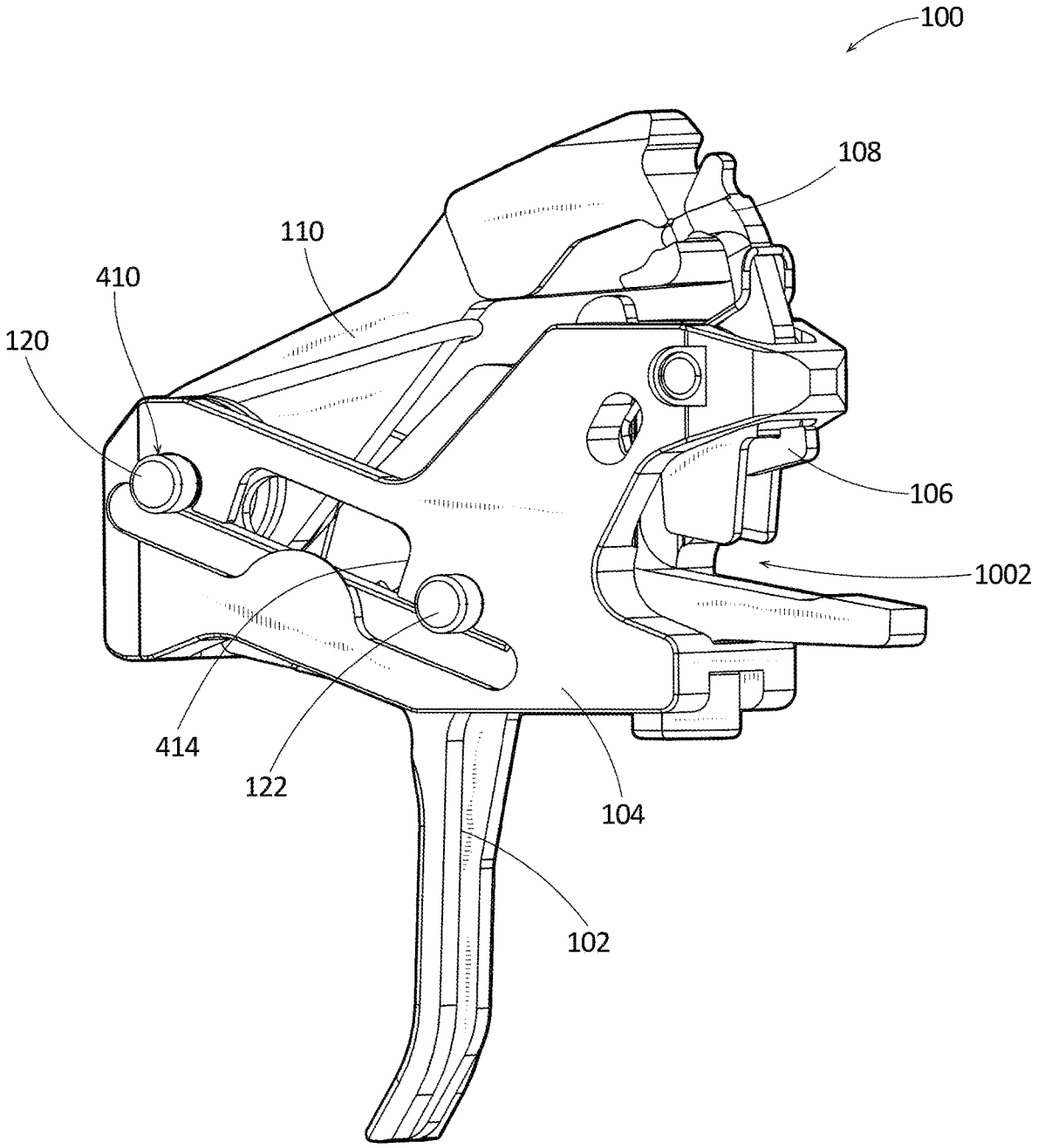
FIG. 1 is a perspective view of a dynamically balanced trigger system according to one or more examples of the disclosure.
Figure 2:
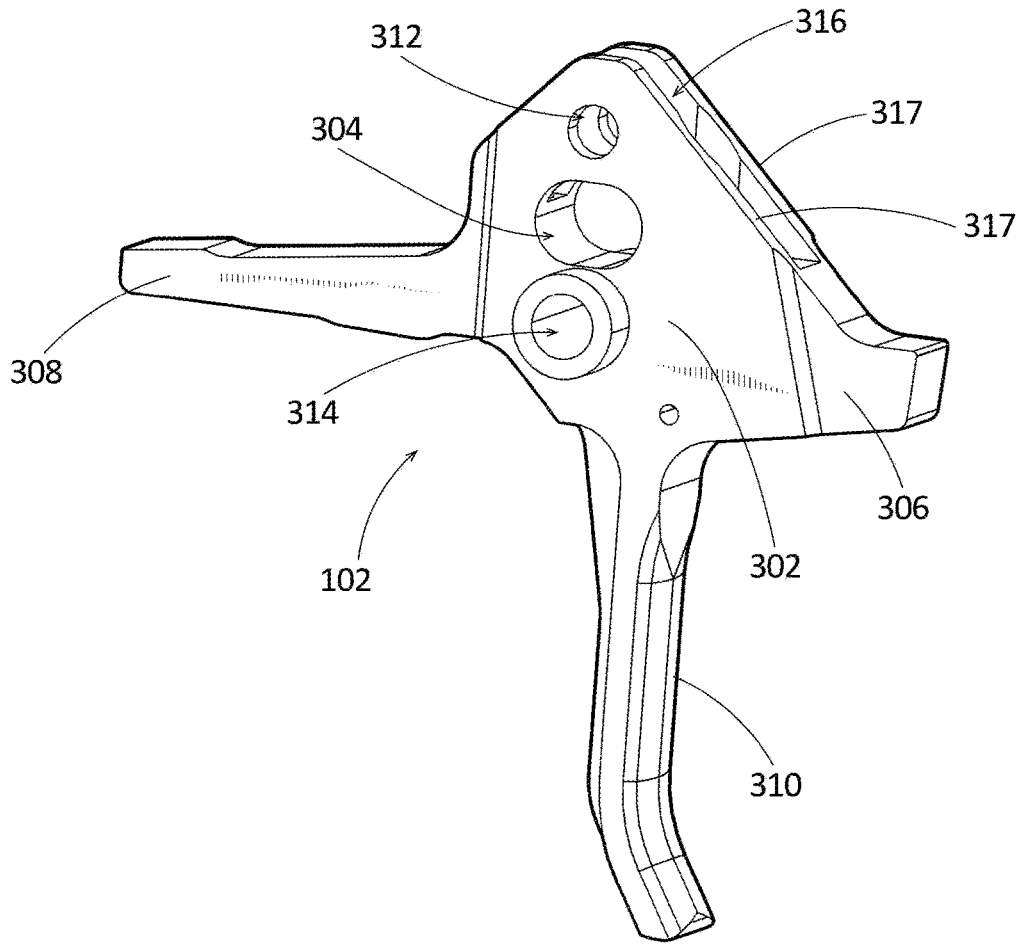
FIGS. 2 and 3A-3B are views of a trigger according to one or more examples of the disclosure.

The present disclosure provides for a dynamically balanced trigger system 100 for a firearm. The dynamically balanced trigger has a specific design, orientation, weights, and cutouts such as to provide a balanced trigger, where the chances of accidental discharge due to drops, shocks, and impacts is dramatically reduced. Unlike other triggers, the dynamically balanced trigger system 100 has a trigger 102 with a center of gravity near the center point of the trigger 102, that is, the axis of rotation, which weights the trigger components against itself to prevent movement, such as may be caused by dropping the firearm, thereby helping prevent an unintentional discharge of the firearm. The dynamically balanced trigger system 100 may be a two-stage trigger, and includes a trigger 102 connected to a disconnector 106 by a disconnector pin 124. The disconnector 106 is configured to be actuated when the trigger 102 is actuated. The disconnector 106 is configured to engage with the sear 108 when actuated, and to actuate the sear 108. The sear 108 is configured to engage with a hammer 110 and release the hammer 110 when the sear 108 is pulled back, away from the hammer 110 so as to disengage from the hammer 110, by the movement of the disconnector 106. The trigger 102, sear 108, and hammer 110 are connected to the housing 104 by various pins 120, 122, and 126.

In some embodiments, the trigger 102 comprises a main body 302, a bore 304 there through the main body 302, a nose 306 configured to be received by the notch 606 of the hammer 110 during one stage of movement, a tail 308 extending parallel to the nose 306 from the opposite end of the trigger for engaging the fire selector of the firearm, and a shoe 310 extending substantially perpendicular to the nose 306 and tail 308. The trigger 102 and its components and cutouts are configured to help properly balance the trigger 102 about a pivot point at bore 314, about which the rigger 102 rotates in operation. For purposes of the present disclosure, a bore may interchangeably be described as a bore, aperture, or void. The bore 314 in the trigger 102 is configured for receiving a trigger pin 122 that secures the trigger 102 to the housing 104 at bore 414, which trigger pin 122 also engages the walls of the firearm receiver into which the trigger system 100 is installed. The trigger 102 may have one connection point for connecting to the housing 104 and firearm (for example, bore 314) and another different connection point for connecting to the disconnector 106 (for example, the bore 312).

The trigger 102 may be balanced around the bore 314, such that the center of gravity of the trigger is at the bore 314, dynamically balancing the trigger 102 in operation. This is achieved, at least in part, by the size and shape of the nose 306 and tail 308, as well as the size and shape of the trigger shoe 310 and bore 304.

Figure 3A:
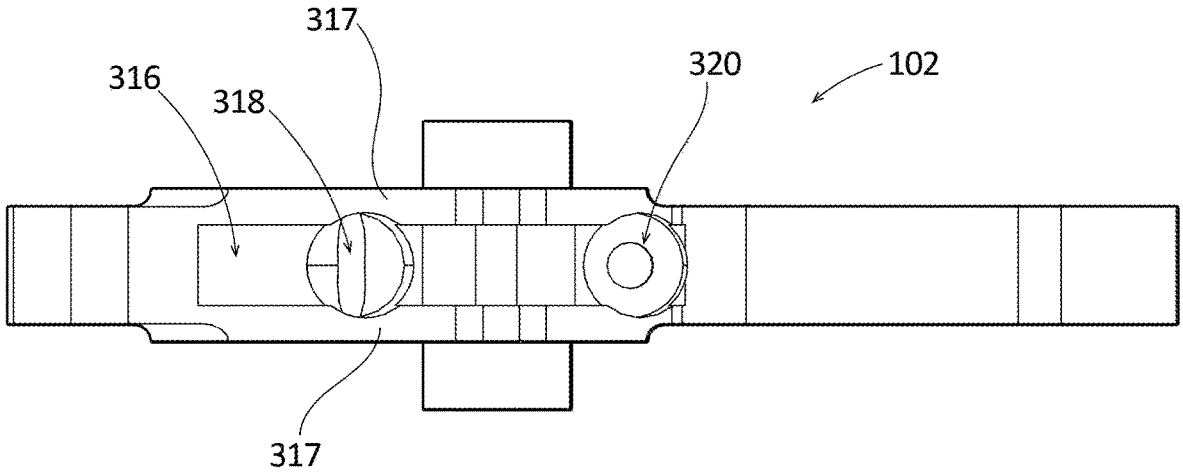
Figure 4A:
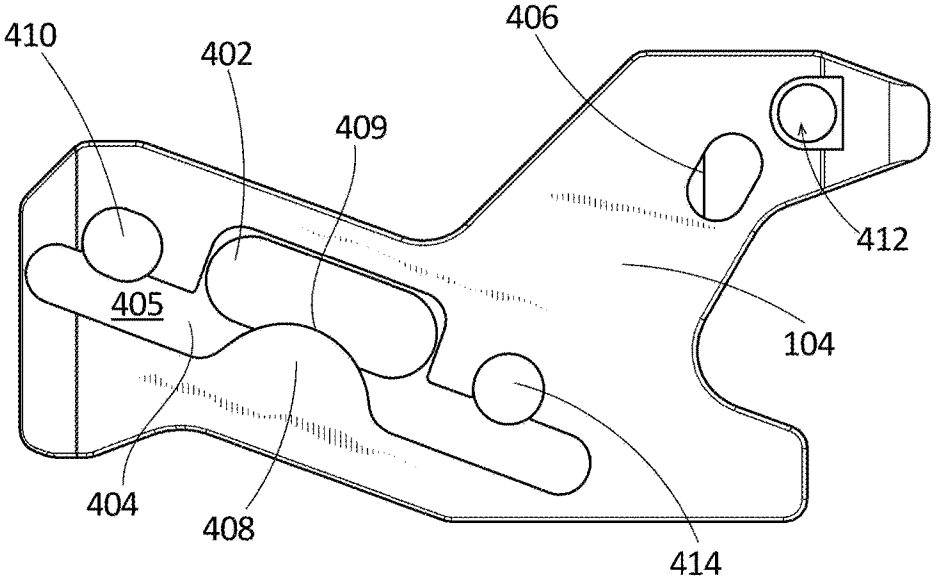
FIGS. 4A-4B, 14-16 are views of a housing according to one or more examples of the disclosure.
Figure 3B:
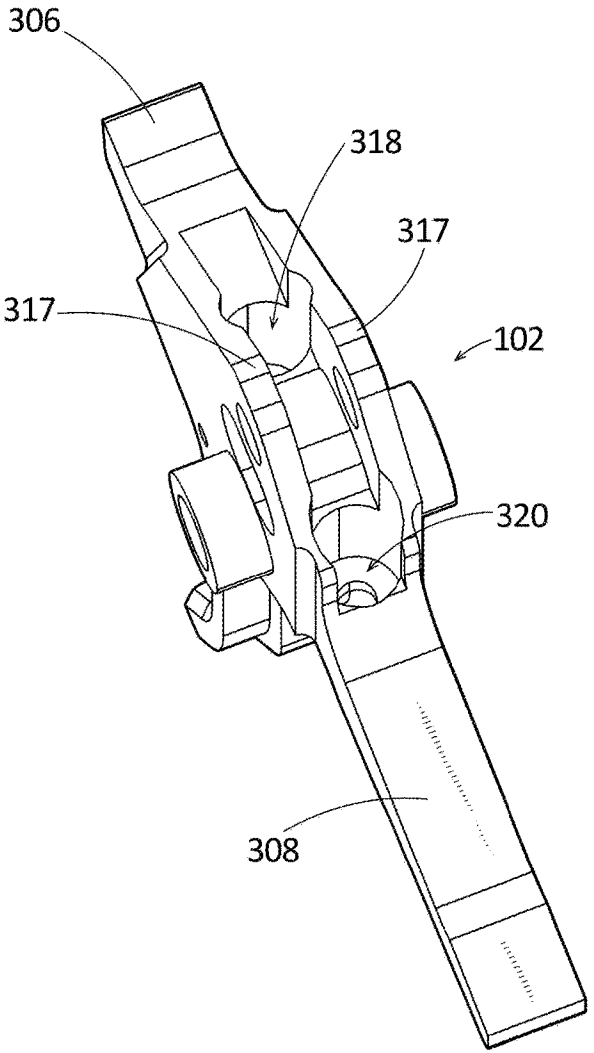
Figure 4B:
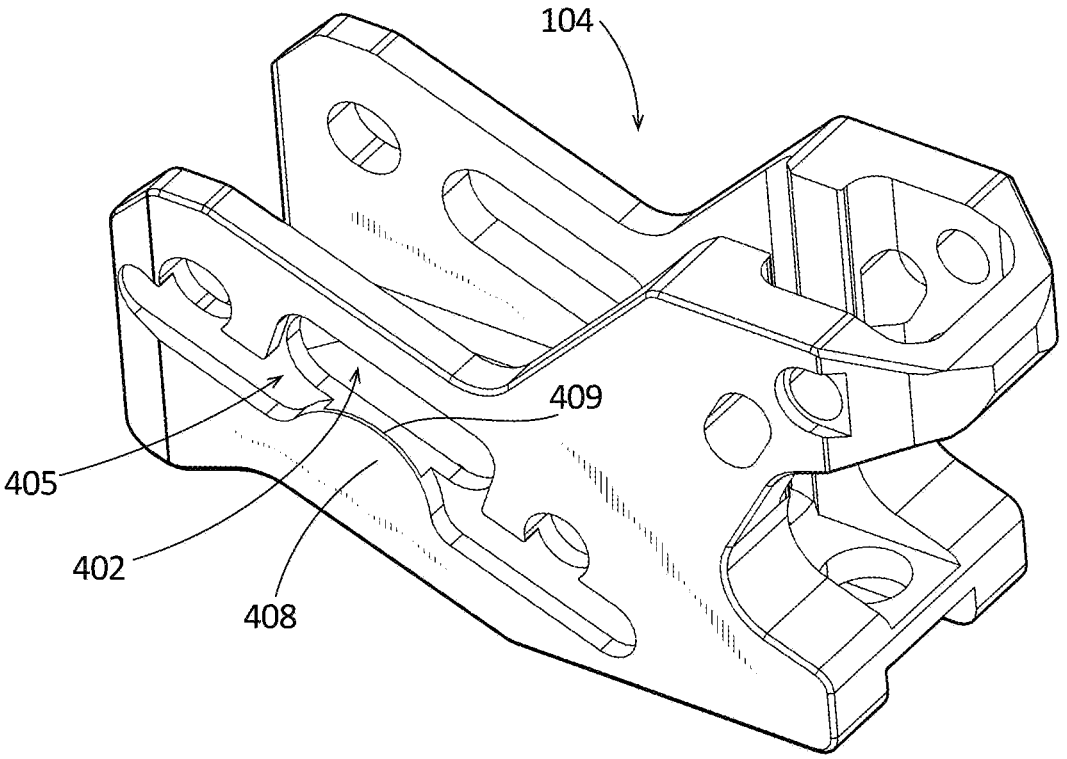
Figure 5:
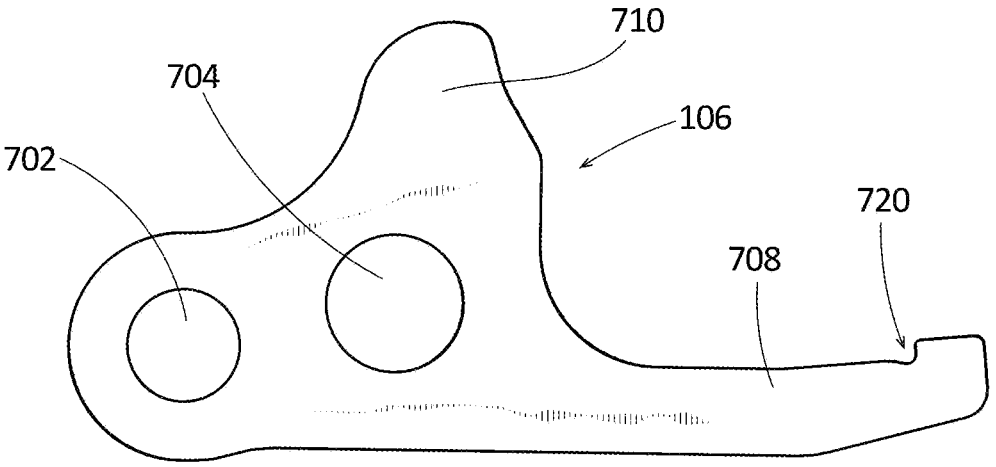
FIG. 5 is a view of a disconnector according to one or more examples of the disclosure.

The slot 304 may be sized, shaped, and disposed relative to the nose 306, tail 308, and shoe 310 to help properly distribute the weight of the trigger 102 about pivot point at bore 314. The top of the main body 302 of the trigger 102 may further comprise a channel 316 defined by parallel walls 317 extending from the main body 302, the channel configured to receive the disconnector 106, which may be secured to the trigger 102 by a disconnector pin 124 through a bore 312 in each of the walls 317. The channel 316 may further comprise a first cavity 320 and a second cavity 318 (see FIGS. 3A and 3B). The first cavity 320 (and certain embodiments the second cavity 318, such as for full-auto fire) have a spring 322 and plunger 324 received therein which biases the disconnector 106 away from the trigger 102. The spring 322 and plunger 324 may be a spring-loaded plunger. In some embodiments, the second cavity 318 may receive a second spring and plunger received therein for biasing a second disconnector away from the trigger 102, wherein the two disconnections are side by side within the channel 316.

In some embodiments, the housing 104 is connected to the trigger 102 by trigger pin 122 inserted through aperture 414, which aligns with bore 314 on the trigger 102. The housing 104 may be connected to a hammer 110 by insertion of a hammer pin 120 through aperture 410, which aligns with bore 610 on the hammer 110. The aperture 410 may not be circular, reducing wear on the aperture 410 and hammer pin 120 by allowing flexibility with respect to the positioning of the hammer pin 120 to the holes in the corresponding receiver of the firearm into which the trigger system 100 is installed. The hammer pin 120 thus may be in a fixed position relative to the housing 104, where the ultimate pin location within aperture 410 is determined based on the lower receiver, not the housing 104. Thus, the slot shape of aperture 410 may provide more flexibility with respect to the position of the hammer pin 120 by providing clearance between the hammer pin 120 and aperture 410. The aperture 410 may be oversized relative to the size of the hammer pin, oblong, oval or any other suitable shape. Thus, the aperture 410 is slot shaped to accommodate movement of the hammer pin 120 relative to the housing 104, such as in the direction toward or away from the trigger pin 122.

The housing 104 may further comprise a first slot 402, a recess 404 in the side wall of housing 104, and a second slot 406. The first slot 402 and recess 404 may abut each other on the face of the housing 104. The first slot 402 may extend through one or both sides of the housing 104. The recess 404 may be disposed below the first slot 402 and only extend partway into the wall of the housing 104. A protrusion 408 may extend into the recess 404 to provide a lip 409 to secure a pin spring 204 between the lip 409 and the recessed surface 405 of the recess 404. The protrusion 408 retains a pin spring 204 by arcing the pin spring 204 against the pins 120, 122 on each end within the recess 404 to keep the hammer pin 120 inserted into aperture 410, and trigger pin 122 inserted into aperture 414 in place. The lip 409 retains the pin spring in place. The hammer pin 120 may have a recess 1201 and trigger pin 122 may have a recess 1221 into which the pin spring 204 rests to secure the respective pins 120, 122. The recesses 1201 and 1221 may be provided on both ends of the respective pins 120 and 122 so that the pins may be inserted in either direction. The second slot 406 may be disposed toward the top front side of the housing 104 and extend through one or both sides of the housing. The housing may have an aperture 412 disposed toward the rear of the housing 104 configured to receive a pin 126 for securing the sear 108 to the housing 104 via bore 508 in the sear 108. The slots 402 and 406 and recess 404 may reduce the weight of the housing to improve performance of the trigger.

Figure 17:
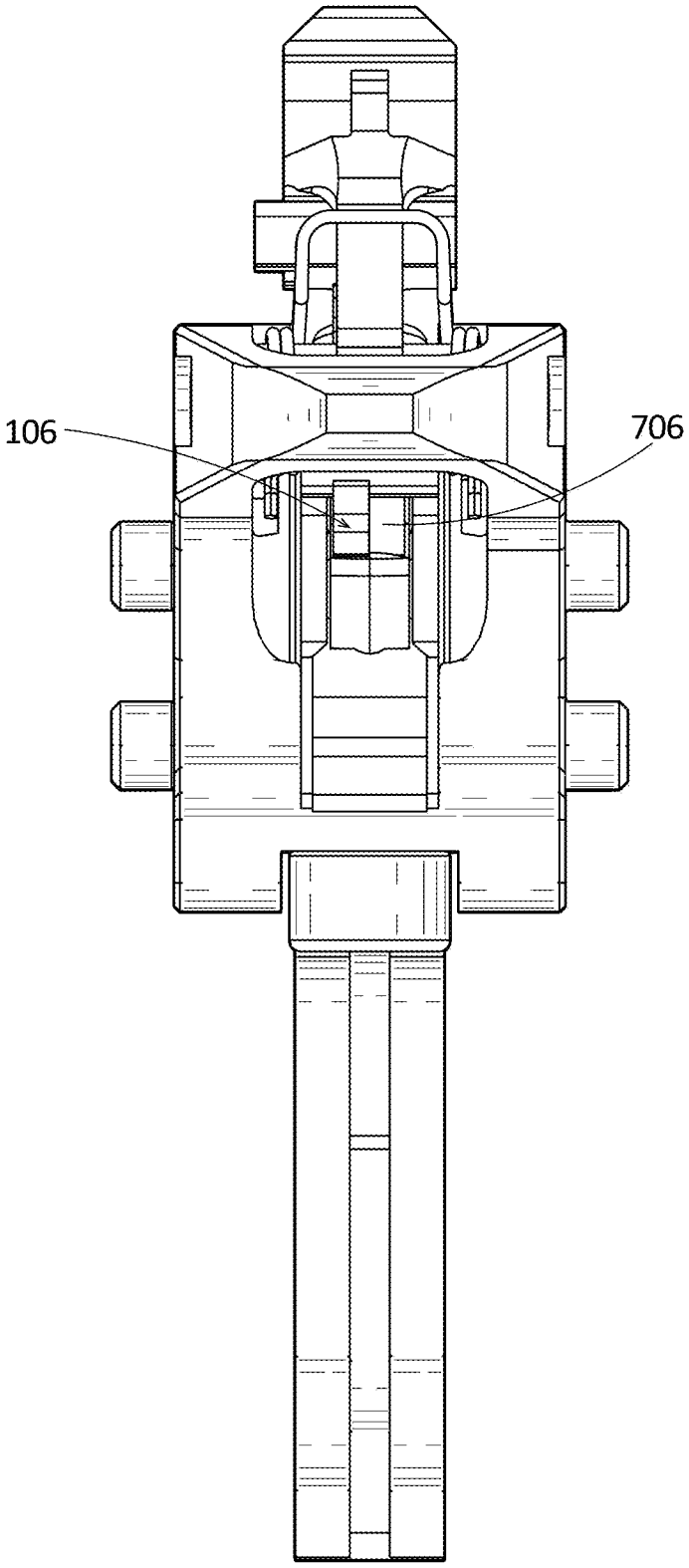
FIG. 17 is a rear view of the dynamically balanced trigger system according to one or more examples of the disclosure.

In some embodiments, the disconnector 106 may be connected to the trigger 102 by a disconnector pin 124 inserted through the bores 312 of trigger 102 and through a bore 702 disposed through the disconnector. The disconnector 106 may have a further bore 704 disposed there through of a desired shape, size and location to distribute the weight of the disconnector 106 relative to the trigger system 100. The disconnector 106 may be disposed within the channel 316 of the trigger 102, and offset to one side from the center of the channel 316 by spacer 706, as shown in FIG. 17. The disconnector 106 may be offset from the center of the channel 316 by a spacer 706 that is inserted on the disconnector pin 124 next to the disconnector 106 within the channel 316. The spacer 706 may be replaced by a second disconnector (not shown) in a fully automatic embodiment of the firearm trigger system 100. The disconnector 106 may be rest on the top of the plunger 324 and spring 322 such that when the trigger 102 is actuated, the spring 322 received in cavity 320 of the trigger is compressed as the disconnector 106 is actuated, that is, moves into engagement with the sear 108. The spring 322 and plunger 324 bias the disconnector 106 against the sear 108, creating an engagement of the disconnector 106 and scar 108 at the notch 720 of the disconnector 106 and ridge 509 of the sear 108. The disconnector 106 has two planes of motion, that is, it both rotates about the disconnector pin 124 and moves forward to back due to the motion of the trigger moving pin 124 within bore 312 of trigger 102 (see, e.g., FIGS. 19 and 20). The disconnector may further have a protrusion 710 and arm 708, where the notch 720 is disposed approximate the distal end of the arm 708. The protrusion 710 of the disconnector 106 may be impacted by the hammer 110 when the firearm is cycling after firing, as the result of the bolt or bolt carrier group moving, and thereby to disconnect the disconnector 106 from the scar 108.

In some embodiments, the sear 108 is connected to the housing at aperture 412 by a scar pin 126 inserted through a bore 508 therein. The sear 108 may have a guide 502 that adjusts or guides the hammer 110 back into position when being cocked after firing. The scar 108 further comprises an engagement ridge 504 that is configured to engage a ledge 604 on the hammer 110. The sear may further comprise a channel 506 between two legs 507. The legs 507 may be of any size, shape, or orientation, such as to balance the sear 108 in combination with the guide 502 and engagement ridge 504. The sear 108 further comprises a scar face 510 which includes the engagement ridge 504 and a portion of the sear extending toward guide 502, parallel to the hammer face 612. The scar face 510 is configured such that a portion of the scar face 510 is parallel with the hammer face 612 when the sear 108 is engaging the hammer 110. Scar face 510 may slide against hammer face 612 when the hammer 110 experiences downward rotation whether by return of the hammer 110 after firing, or due to drops, shocks, or bumps.

Figure 6B:
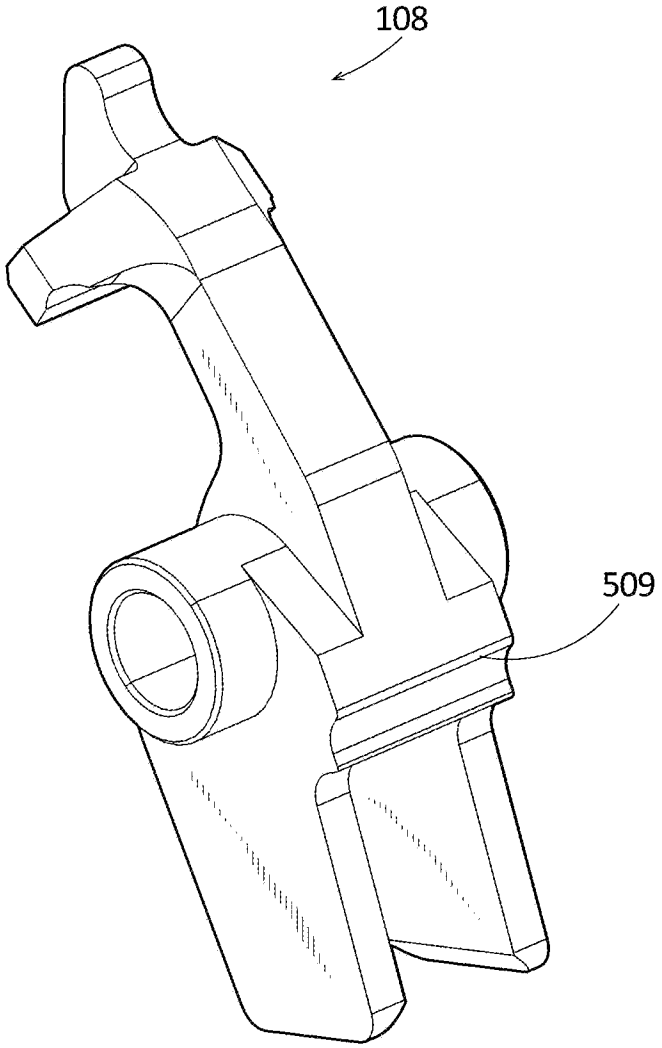
FIGS. 6A-6B are views of a sear according to one or more examples of the disclosure.
Figure 6A:
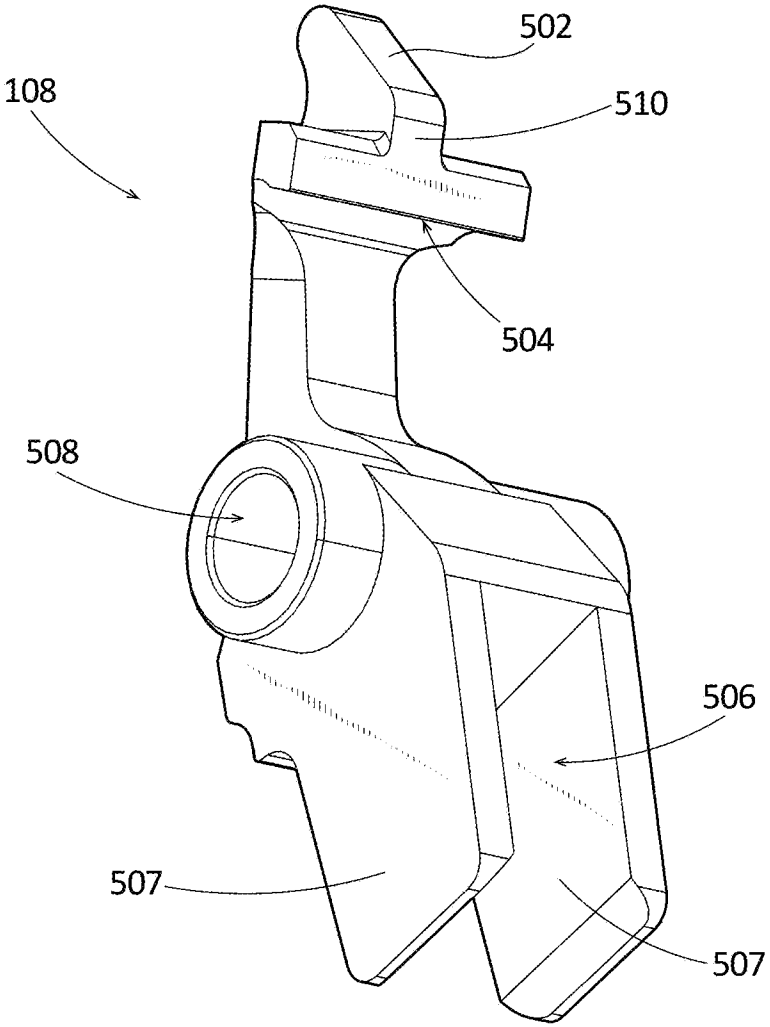
Figure 7:
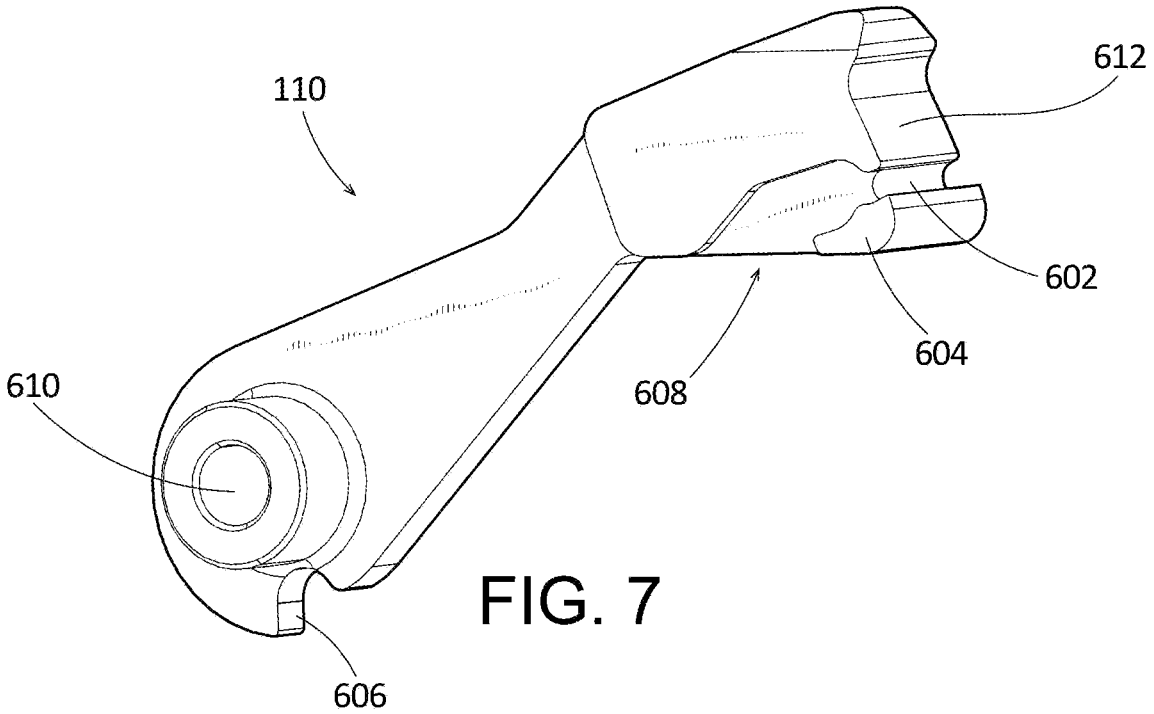
FIGS. 7-8 are views of a hammer according to one or more examples of the disclosure.
Figure 8:
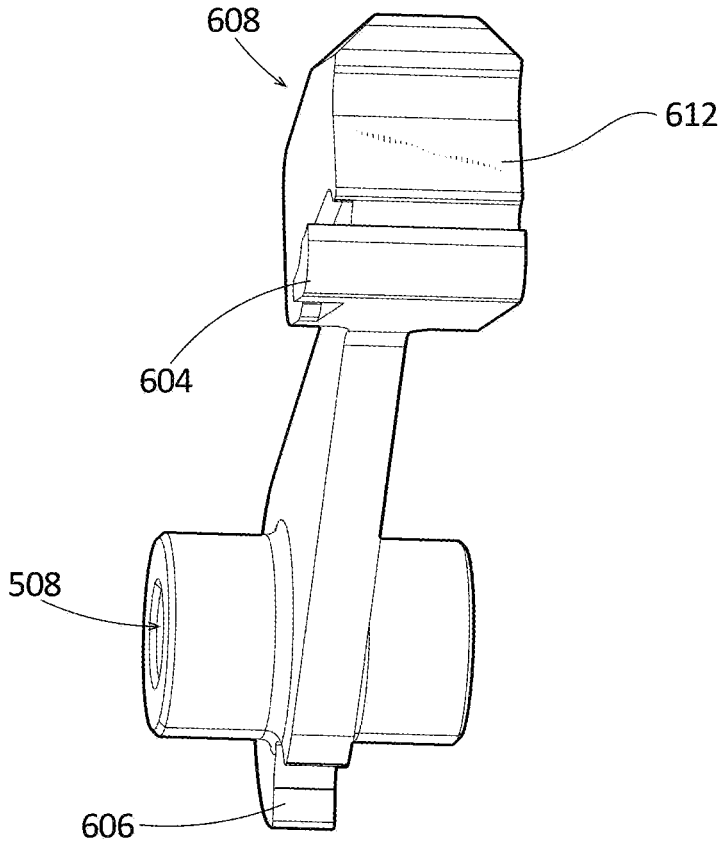
Figure 9:
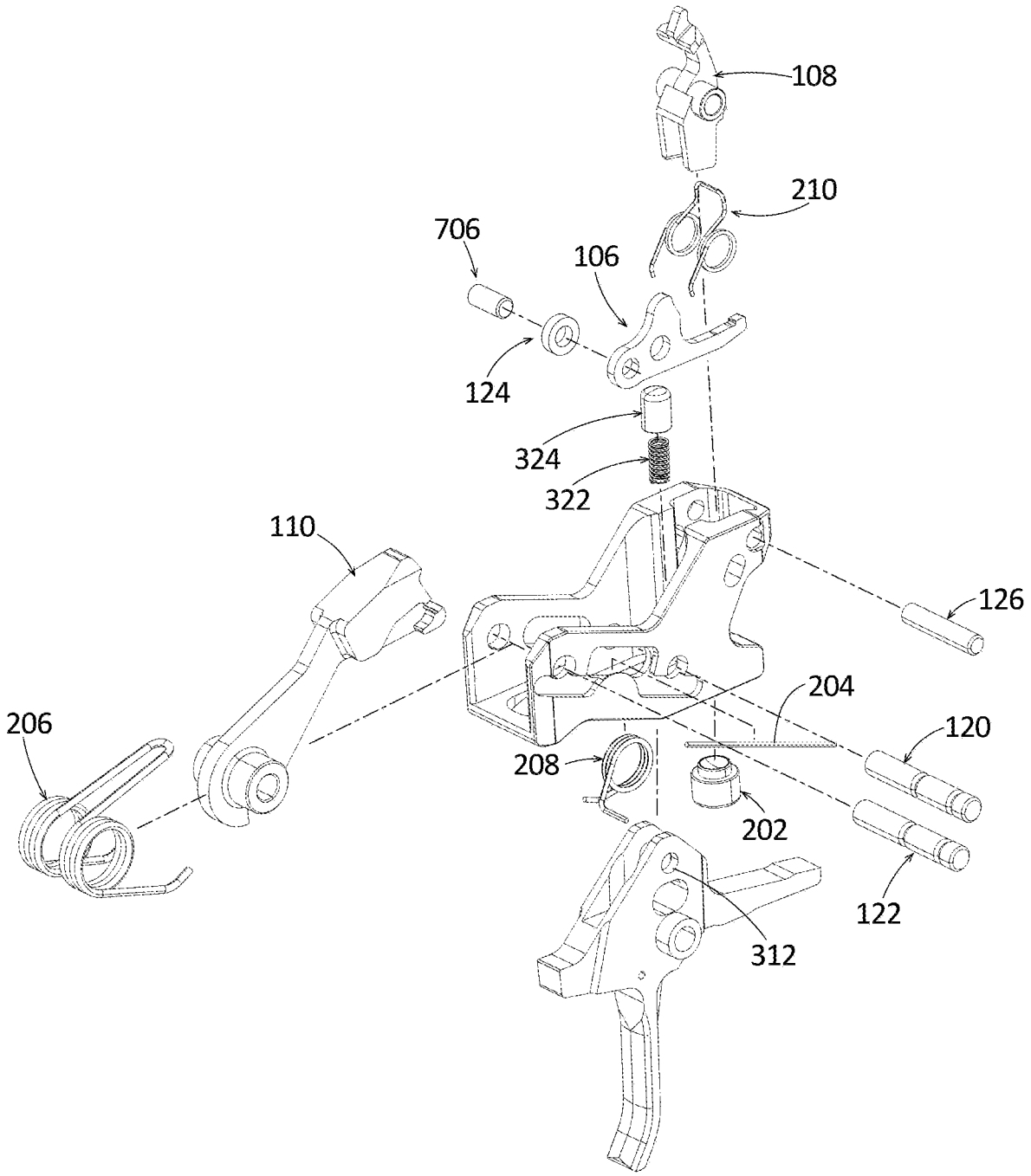
FIG. 9 is an exploded view of the dynamically balanced trigger system according to one or more examples of the disclosure.
Figure 11:
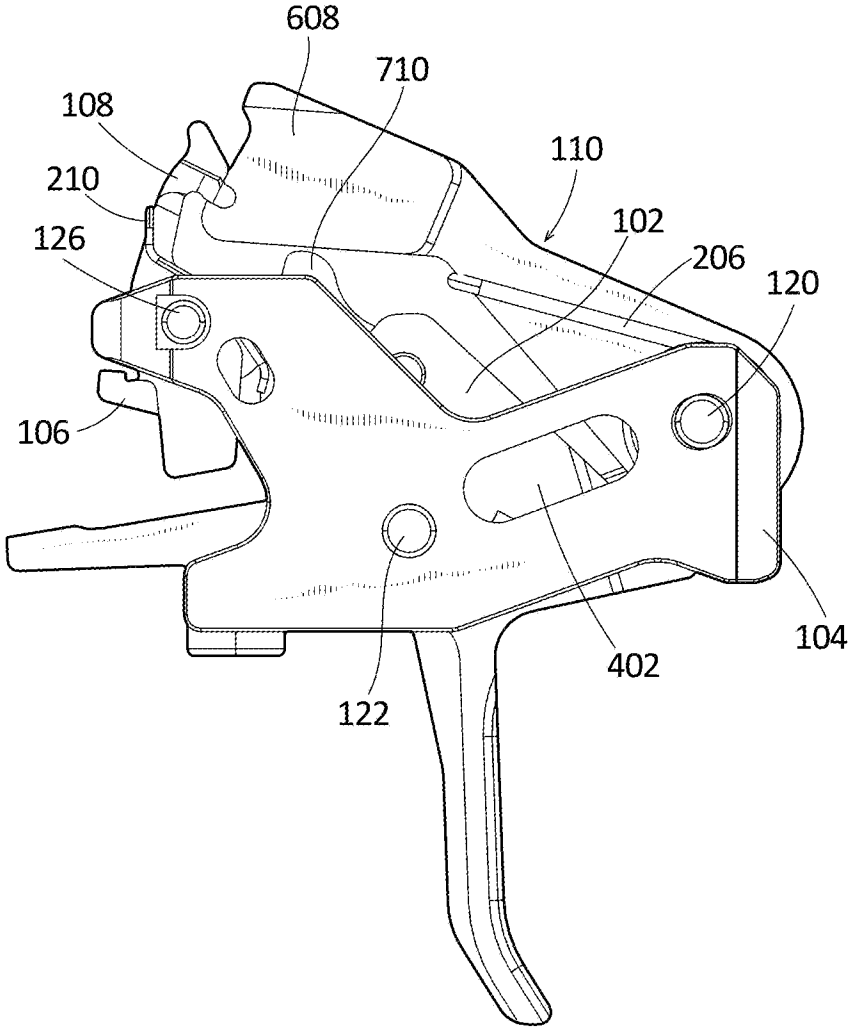
FIGS. 10-11 are side views of the dynamically balanced trigger system according to one or more examples of the disclosure.
Figure 10:
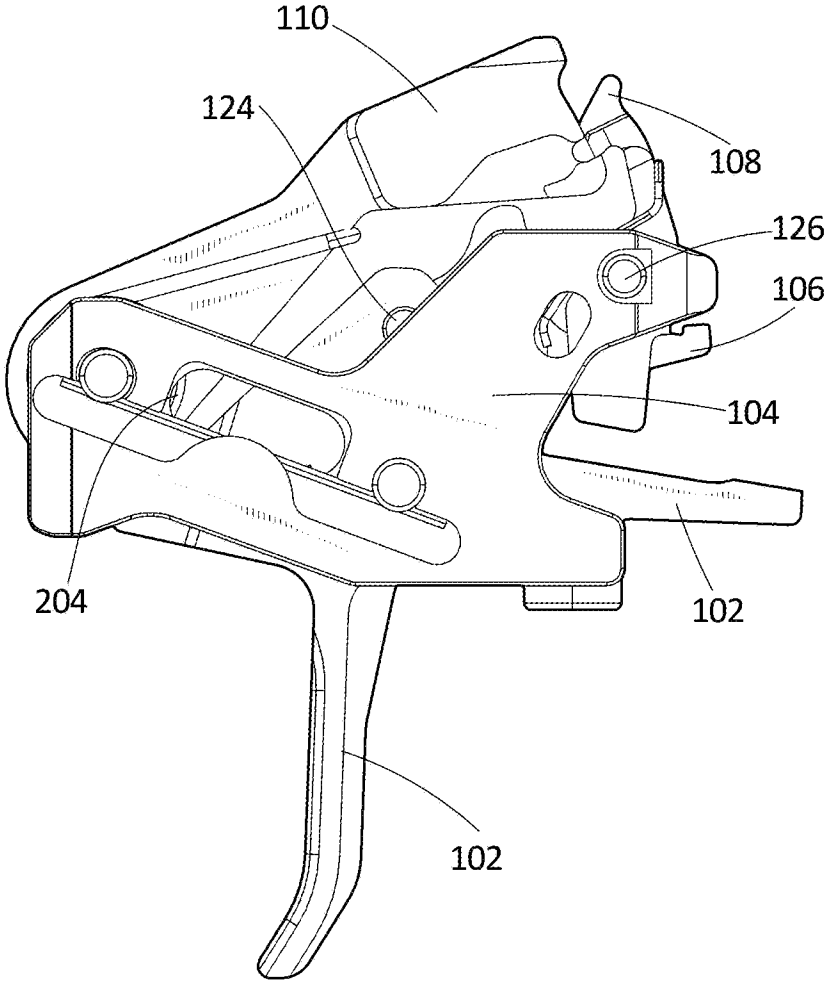

The parallel faces allow for the sear 108 to slide relative to the hammer 110 instead of becoming disconnected when the hammer 110 experiences downward rotation. The scar face 510 may include the engagement ridge 504 extending laterally from either side of the guide 502 to provide a wide contact surface for engaging the hammer. The sear 108 may be of any size or shape to ensure the weight of the sear 108 is properly centered about the scar pin bore 508. The scar 108 may further comprise a ridge 509 (see FIG. 6B) that is configured to engage the notch 720 of the disconnector 106 when the trigger is in the cocked position (see FIG. 20), causing the sear 108 to rotate about scar pin 126 through bore 508 of the sear 108 and aperture 412 of the housing. The sear 108, when caused to rotate in response to movement of the disconnector 106, as the notch 720 engages the ridge 509 of the sear 108, may cause the ridge 504 of the sear 108 to disengage from the ledge 604 of the hammer 110, releasing the hammer 110.

In some embodiments, the hammer 110 is connected to the housing 104 by a hammer pin 120 inserted through bore 610 of the hammer into aperture 410 of the housing. The hammer may have a notch 606 configured to prevent firing motion of the hammer 110 when the trigger is not actuated. The notch 606 would impact against the trigger nose 306 if there were any rotation of the hammer 110 about hammer pin 120 without actuating the trigger 102. The ledge 604 may have a platform 602 that mates with the engagement ridge 504 of the sear 108 when the trigger system 100 is cocked. The sear 108 may engage the hammer 110 from above. The hammer 110 is engaged from its top side by the sear 108, that is, at the end opposite the rotation about bore 610 of the hammer.

In some embodiments, a slave pin 121 may be disposed in place of the hammer pin 120 prior to installation in a firearm to maintain the trigger system 100 assembly. In addition, a slave pin 123 may be disposed in place of the trigger pin 122 prior to installation in a firearm to maintain the trigger system 100 assembly. The slave pins may be ejected as the pins 120 and 122 are inserted during the installation of the dynamic trigger system 100 within a firearm receiver. The hammer pin 120 and trigger pin 122 are configured to be held in place by pin spring 204 engaging recesses 1201 and 1221, respectively, in each of pins 120 and 122.

Thus, the pin spring is held in place by the lip 409 and recess surface 405, and is biased again the hammer pin 120 and trigger pin 122 by protrusion 408. Thus, the pins 120 and 122 are held in place independent of any functional springs 206, 208 or 210, but by a pin spring 204 integrated into the housing 104.

In some embodiments, the dynamic trigger system 100 further comprises a bumper 202 attached to a hole 220 in the housing 104. The bumper 202 may comprise a rubber or pliable material, and when the trigger system 100 is installed in a receiver of a firearm, is compresses between the housing 104 and floor of the firearm receiver, thereby eliminating movement of the housing, and may prevent over rotation of the trigger 102 by a portion of the bumper 202 extending through the hole 220 contacting tail 308 of the trigger 102. In other words, the bumper preloads the housing to the bottom of the receiver and prevents movement of the housing 104 as the trigger system 100 is operating.

In some embodiments, a spring 206 may bias the hammer 110 away from the housing 104 and trigger 102. The spring 206 may be disposed around the hammer pin 120. The spring 206 may be configured to bias the hammer 110 to rotate in a direction away from the sear 108 and the disconnector 106. The spring 206 may force the hammer 110 into the striking position when the sear 108 is disengaged from the hammer 110.

In some embodiments, a spring 208 may offer resistance to the actuation of the trigger 102 relative to the housing 104. The spring 208 may be disposed around the trigger pin 122. The spring 208 may be configured to resist the actuation motion, that is, the pulling on or squeezing of the trigger shoe 310 of the trigger 102.

In some embodiments, a spring 210 may connect the sear 108 and the housing 104 and bias the sear face 510 of the sear 108 toward the hammer 110. The spring 210 may be disposed around pin 126.

Figure 12:
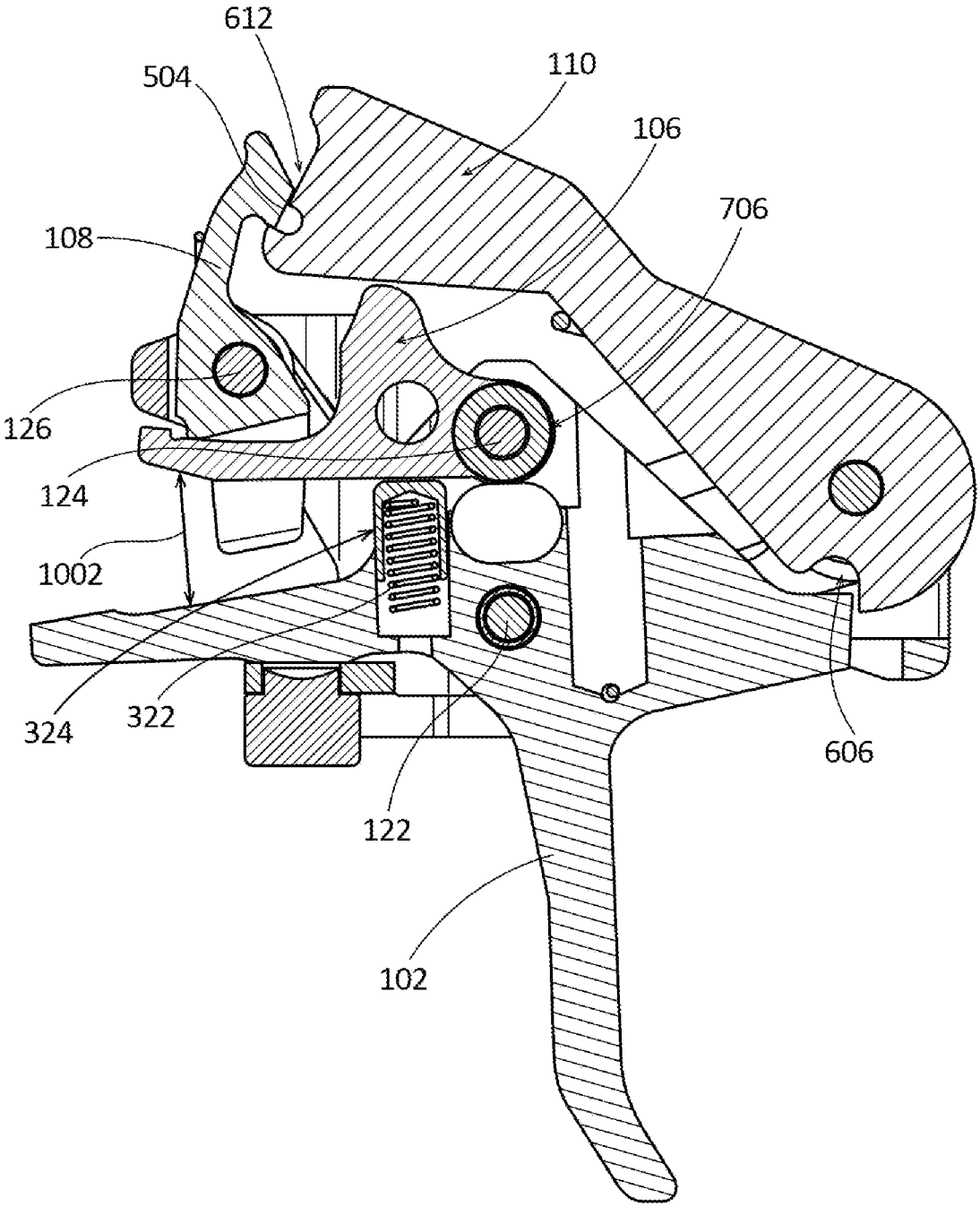
FIG. 12 is a cutaway side view of the dynamically balanced trigger system according to one or more examples of the disclosure.
Figure 13:
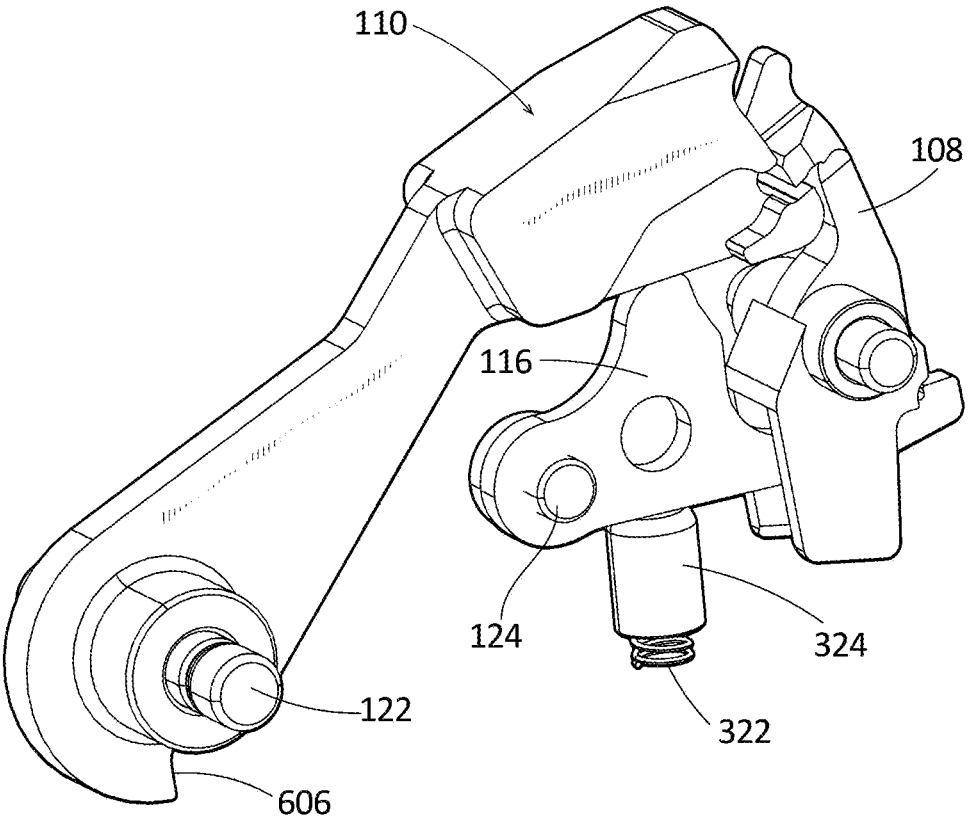
FIG. 13 is a perspective view of various interior components, within the housing, of the dynamically balanced trigger system according to one or more examples of the disclosure.
Figure 14:
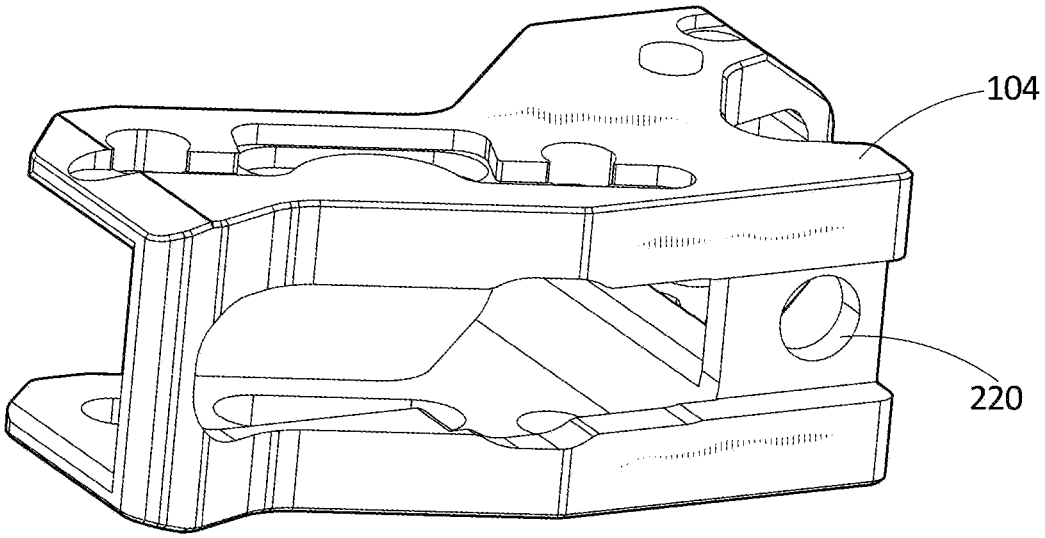
Figure 15:
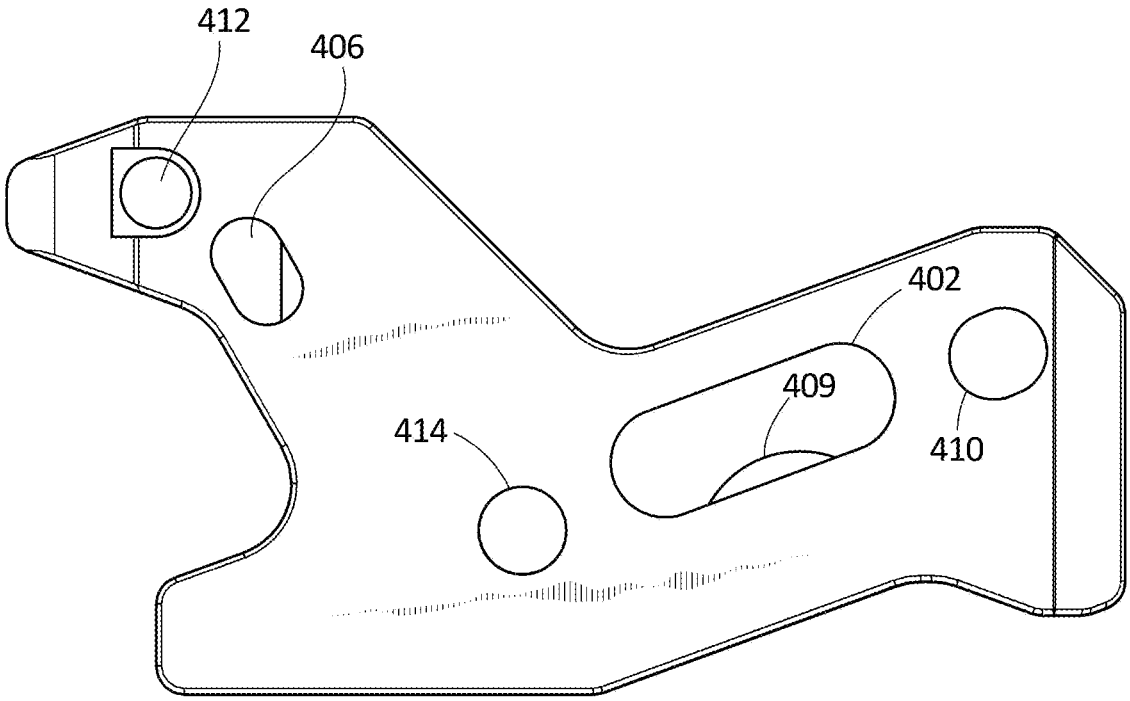

The trigger 102 and disconnector 106 have gap 1002 in between the disconnector arm 708 and trigger tail 308 (see FIG. 12). The gap 1002 is configured to provide distance between the trigger 102 and disconnector 106 to prevent trigger slap when the hammer 110 returns to its cocked position.

Figure 16:
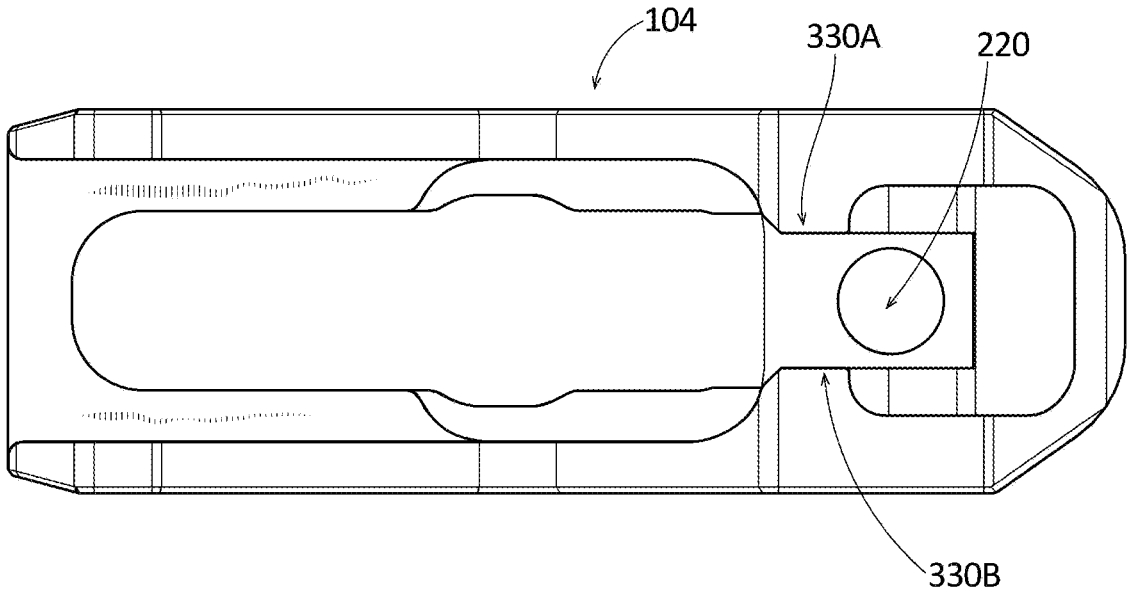

With reference to FIG. 16, the housing 104 has a first wing 330A and a second wing 330B which extend partially across the housing 104. Thus, when the hammer 110 rotates from a firing position to a cocked position, the head 608 of the hammer 110 may impact one or both of the wings 330A, 330B to limit rotation of the hammer 110, thereby limiting the impact force of the hammer 110 on the disconnector 106, and in particular, the protrusion 710 of the disconnector 106, further preventing trigger slap, as the hammer 110 disengages the disconnector 106 from the sear 108.

Figure 19:
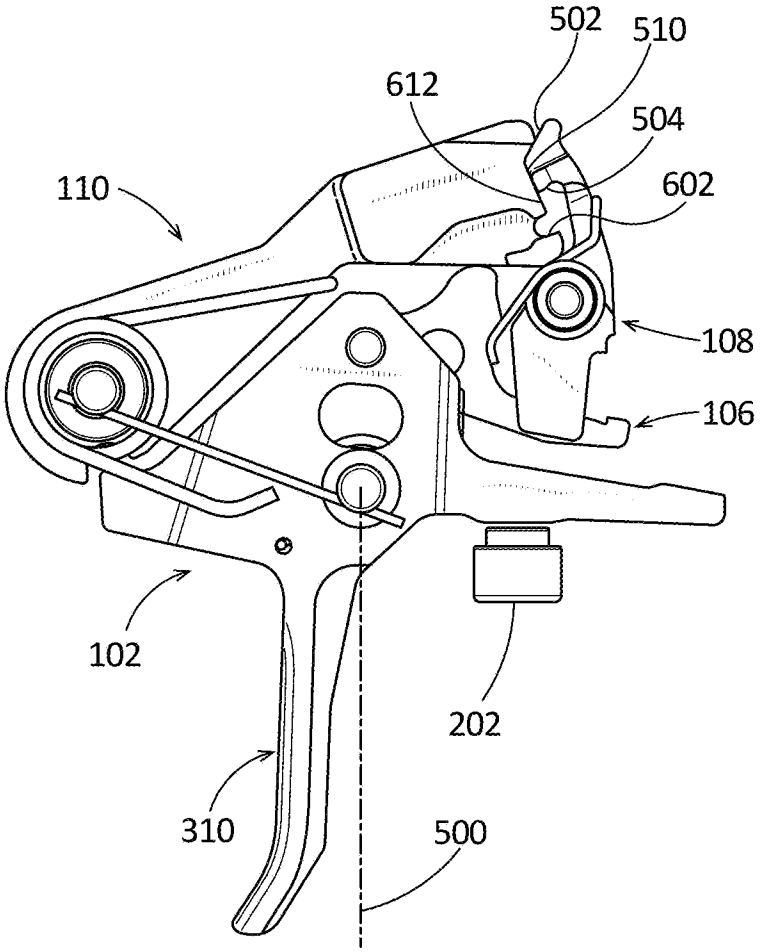
FIGS. 18-22 are views of the dynamically balances trigger system without the housing in states of actuation according to one or more examples of the disclosure.
Figure 18:
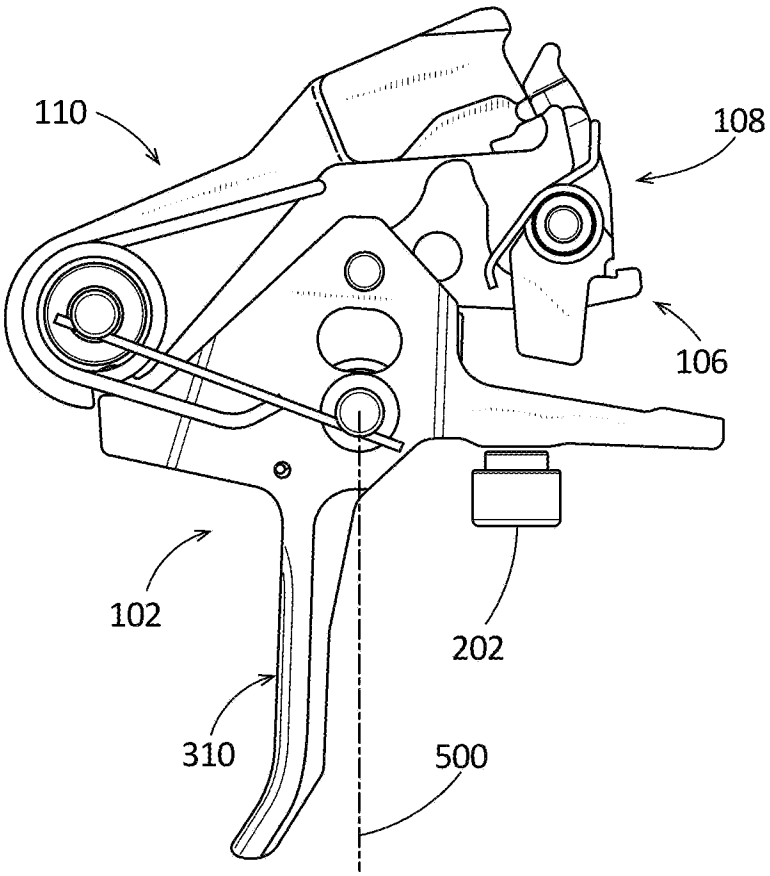
Figure 21:
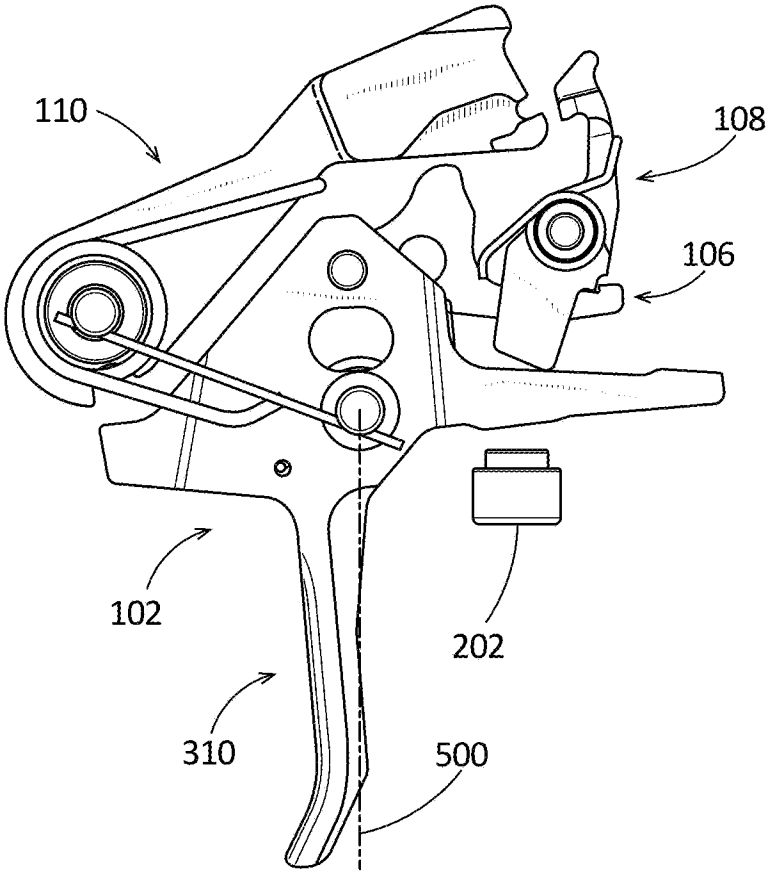
Figure 20:
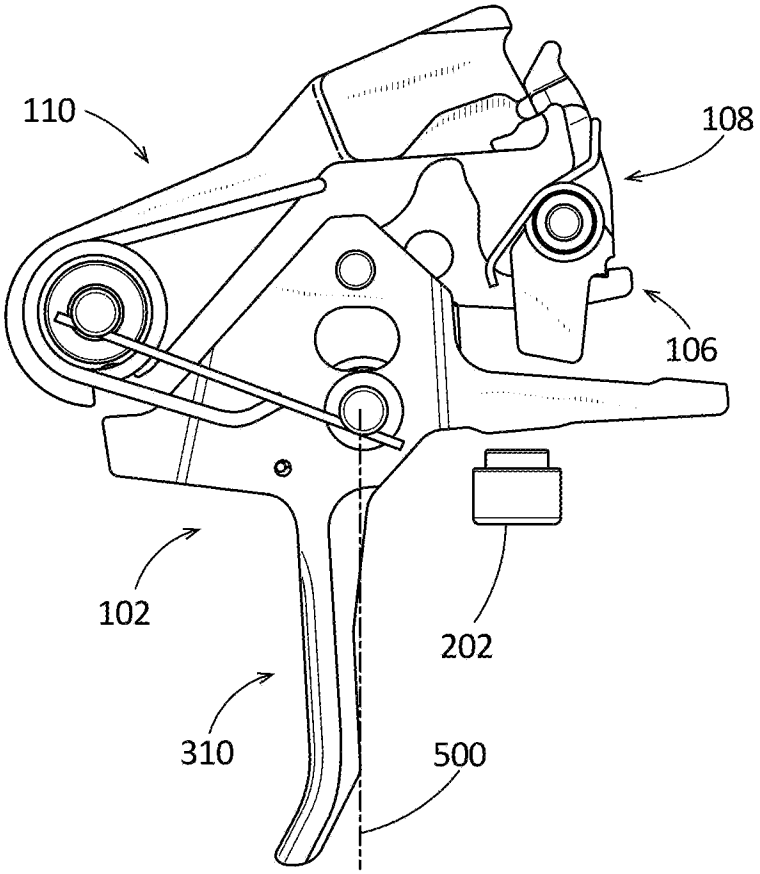
Figure 22:
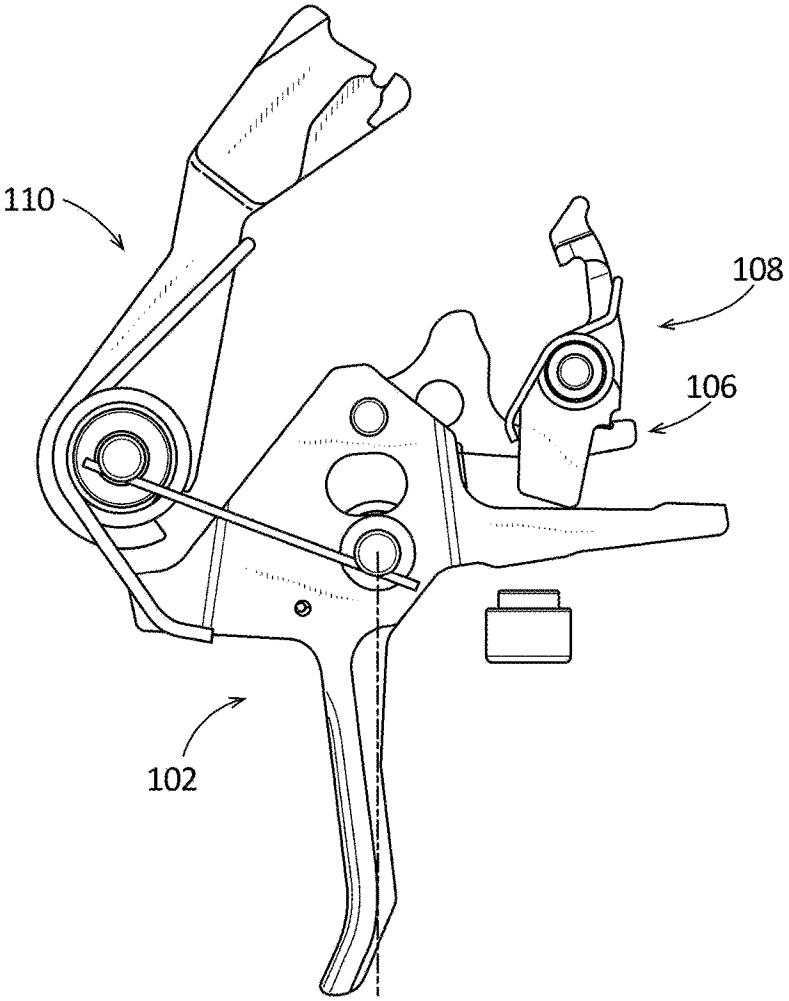

In FIGS. 18-22 the operation of the trigger assembly is illustrated. In FIG. 18, upon firing a semiautomatic firearm utilizing the trigger assembly 100, the hammer 110 may be driven in an initial motion back into contact with the disconnected 106, which motion may be limited by the hammer 110 contacting one or more of wings 330A and/or 330B. In FIG. 19, the hammer 110, under the bias of spring 206, moves into engagement with the sear 108 at the engagement ridge 504 of the sear 108 and platform 602 of the hammer 110. In this position, the disconnector 106 moves upward under the bias of the plunger 324 and spring 322, putting the disconnector 106 in contact with the sear 108 and the hammer 110. In FIG. 20, as the trigger is actuated, as shown relative to the reference line 500, the notch 720 of the disconnector 106 engages the ridge 509 of the sear 108. At this point, often referred to as the wall, the movement of the trigger in an actuation direction comes under noticeably higher resistance as actuation of the trigger 102 now has to overcome the bias of the spring 210 that resist movement of the sear 108 (in the clockwise direction, away from the hammer 110, based on the view shown in FIG. 20). By increasing the pressure on the trigger shoe 310, a slight movement of the trigger 102, as illustrated relative to the reference line 500 between FIGS. 20 and 21, the sear is rotated away from the hammer 110, disengaging the engagement ridge 504 of the sear 108 from the platform 602 of the hammer 110, releasing the hammer 110, under the bias of spring 206. The hammer 110, as shown in FIG. 22, may then strike the bolt under the force of spring 206, causing a discharge of the firearm. The return of the hammer 110 to the position shown in FIG. 18 may be facilitated by the bold carrier group of the firearm during the recoil motion of the firearm. It is noted, with reference back to FIG. 18, the downward force of the hammer 100 striking the disconnector 106 disengages the disconnector 106 from the sear 108, as shown.

In some embodiments, the trigger assembly 100 may be formed by the parts of the trigger 102, disconnector 106, disconnector pin 124, spring 322, and plunger 324. The trigger assembly may be formed of parts of the trigger system 100 that are connector to the trigger 102 and not mounted into the firearm receiver themselves. The trigger assembly may be balanced such that its center of gravity is at the bore 314 of the trigger 102, which may also be at the trigger pin 122 about which the trigger 102 rotates in operation. The trigger assembly may be balanced about the bore 314 so that when the trigger 102 is cocked and in a ready-to-fire state, there will be no or little moment in the trigger assembly that would create momentum that may result in movement or rotation of the trigger 102 about the trigger pin 122, that may result in an accidental discharge. When the trigger assembly is balanced in this manner, when undergoing a muzzle-down drop safety test there is little to no moment or rotation about the trigger pin 122 that would cause undesired discharge. The trigger assembly may be balanced by the weight distribution of its various parts. On the trigger 102, for instance, the trigger shoe 310 may be contoured to reduce weight, particularly at the distal end further away from the bore 314, the second cavity 318 may be added not only for full auto functionality but for weight savings and balance, the nose 306 and tail 308 may be contoured to reduce weight, particularly at the distal ends thereof that are further away from the bore 314, and the slot 304 may be added for balance. In addition, with respect to the disconnector 106, the disconnector bore 704, protrusion 710 and arm 708, which are disposed at a distance from the bore 314, may be sized and shaped to minimize the weight of the disconnector 106 and specifically position said weight of the disconnector 106 as a part of the balance of the trigger assembly as well. In one embodiment, the balance is achieved by removing weight at the locations furthest from the center of gravity, such as by adding the bore 704 and shaping the protrusion 710 and arm 708 to minimize weight of those parts while maintaining the durability of those features.

In some embodiments, the sear 108 may be balanced about the bore 508, which is at the point the sear 108 rotates about the sear pin 126. The guide 502, engagement ridge 504, and neck extending from the bore 508 to the guide 502 and ridge 504, may be configured to minimize their weight while retaining the requisite durability, and the legs 507 may shape and sized to balance the weight of the neck, guide 502 ridge 504 and other features on the opposite side of the bore 508 to have the center of gravity of the sear 108 at the bore 508/scar pin 126. The balance of the sear may be in a cocked and ready-to-fire state, thus preventing or substantially eliminating any unwanted moment about the bore 508 that would create momentum in the sear 108 that might cause it to become disconnected from the hammer 110 so that it might result in an accidental discharge, such as during a drop safety test or a similar event. The sear 108 being balanced helps prevent the flexure of various parts when the sear is pulled.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

Embodiments of the disclosure can be described in view of one or more of the following:

Embodiment 1 may include a trigger system comprising: a housing; a trigger rotationally coupled to the housing about a first bore of the trigger; a disconnector coupled to the trigger at a second bore of the trigger: a hammer rotationally coupled to the housing at a first end; and a sear operably engaging the disconnector and the hammer, and rotationally coupled to the housing; wherein the trigger is substantially balanced about the first bore.

Embodiment 2 may include Embodiment 1, wherein the trigger includes a cavity that receives a spring-loaded plunger that biases the disconnector into engagement with the sear.

Embodiment 3 may include any one of Embodiments 1 to 2, wherein disconnector includes a bore or recess configured to reduce the weight of the disconnected.

Embodiment 4 may include any one of Embodiments 1 to 3, wherein the trigger includes a trigger shoe that extends away from the first bore, and a tail member and a head member extending from the first bore in substantially opposite directions.

Embodiment 5 may include any one of Embodiments 1 to 4, wherein the housing includes a wing structure that engages the hammer to limit rotation of the hammer in a direction toward the disconnector.

Embodiment 6 may include any of Embodiments 1 to 5, wherein the trigger is coupled to the housing by a trigger pin and the hammer is coupled to the housing by a hammer pin, and wherein the housing defines a recess configured to receive a spring that retains the hammer pin and the trigger pin.

Embodiment 7 may include any of Embodiments 1 to 6, wherein the recess includes a protrusion that biases the spring against the hammer pin and the trigger pin.

Embodiment 8 may include any of Embodiments 1 to 7, wherein the protrusion includes a lip that retains the spring in the recess.

Embodiment 9 may include any of Embodiments 1 to 8, wherein the housing includes a compressible bumper that is configured to prevent movement of the dynamically balanced trigger system when installed.

Embodiment 10 may include any of Embodiments 1 to 9, wherein the housing includes a bore configured to receive a hammer pin that couples the hammer to the housing, wherein the bore is non-circular.

Embodiment 11 may include any of Embodiments 1 to 10, wherein the sear is coupled to the housing by a sear pin that is received by a bore in the sear, wherein the sear is substantially balanced about the bore in the sear.

Embodiment 12 may include a firearm, comprising: an upper; a barrel connected to the upper; a receiver; and a trigger system disposed within the receiver, the trigger system comprising, a housing; a trigger rotationally coupled to the housing about a first bore of the trigger; a disconnector coupled to the trigger at a second bore of the trigger: a hammer rotationally coupled to the housing at a first end; and a sear operably engaging the disconnector and the hammer, and rotationally coupled to the housing; wherein the trigger is dynamically balanced about the first bore.

Embodiment 13 may include Embodiment 12, wherein the trigger includes a cavity that receives a spring-loaded plunger that biases the disconnector into engagement with the sear.

Embodiment 14 may include any one of Embodiments 12-13, wherein the trigger includes a trigger shoe that extends away from the first bore, and a tail member and a head member extending from the first bore in substantially opposite directions.

Embodiment 15 may include any one of Embodiments 12-14, wherein the trigger is coupled to the housing by a trigger pin and the hammer is coupled to the housing by a hammer pin, and wherein the housing defines a recess configured to receive a spring that retains the hammer pin and the trigger pin, wherein the recess includes a protrusion that biases the spring against the hammer pin and the trigger pin, and wherein the protrusion includes a lip that retains the spring in the recess.

Embodiment 16 may include any one of Embodiments 12-15, wherein the trigger is coupled to the housing by a trigger pin and the hammer is coupled to the housing by a hammer pin, and wherein the housing defines a recess configured to receive a spring that retains the hammer pin and the trigger pin.

Embodiment 17 may include any one of Embodiments 12-16, wherein the recess includes a protrusion that biases the spring against the hammer pin and the trigger pin.

Embodiment 18 may include any one of Embodiments 12-17, wherein the protrusion includes a lip that retains the spring in the recess.

Embodiment 19 may include any one of Embodiments 12-18, wherein the housing includes a compressible bumper that is configured to prevent movement of the dynamically balanced trigger system when installed.

Embodiment 20 may include any one of Embodiments 12-19, wherein the housing includes a bore configured to receive a hammer pin that couples the hammer to the housing, wherein the bore is non-circular.

The invention claimed is:

1. A trigger system comprising:
- a housing;
- a trigger assembly comprising,
  - a trigger rotationally coupled to the housing about a first bore of the trigger, and
  - a disconnector coupled to the trigger at a second bore of the trigger,
  - wherein the trigger assembly is substantially balanced about the first bore;
- a hammer rotationally coupled to the housing at a first end; and
- a sear operably engaging the disconnector and the hammer, and rotationally coupled to the housing.

2. The trigger system of claim 1, wherein the trigger includes a cavity that receives a spring-loaded plunger that biases the disconnector into engagement with the sear.

3. The trigger system of claim 1, wherein the disconnector includes a bore or recess configured to reduce a weight of the disconnector, and alter a position of a center of mass of the trigger assembly.

4. The trigger system of claim 1, wherein the trigger includes a trigger shoe that extends away from the first bore, a tail member and a head member extending from the first bore in substantially opposite directions.

5. The trigger system of claim 1, wherein the housing includes a wing structure that engages the hammer to limit rotation of the hammer in a direction toward the disconnector.

6. The trigger system of claim 1, wherein the trigger is coupled to the housing by a trigger pin and the hammer is coupled to the housing by a hammer pin, and wherein the housing defines a recess configured to receive a spring that retains the hammer pin and the trigger pin.

7. The trigger system of claim 6, wherein the recess includes a protrusion that biases the spring against the hammer pin and the trigger pin.

8. The trigger system of claim 7, wherein the protrusion includes a lip that retains the spring in the recess.

9. The trigger system of claim 1, wherein the housing includes a compressible bumper that is configured to prevent movement of the dynamically balanced trigger assembly when installed.

10. The trigger system of claim 1, wherein the housing includes a bore configured to receive a hammer pin that couples the hammer to the housing, wherein the bore is non-circular.

11. The trigger system of claim 1, wherein the sear is coupled to the housing by a sear pin that is received by a bore in the sear, wherein the sear comprises,
- a middle portion that comprises the bore,
- a neck portion that extends from a first side of the middle portion,
- two legs that extend from a second side of the middle portion, the second side being substantially opposite the first side,
- wherein the sear is substantially balanced about the bore in the sear.

12. A firearm, comprising:
- an upper;
- a barrel connected to the upper;
- a receiver; and
- a trigger system disposed within the receiver, the trigger system comprising,
  - a housing,
  - a trigger rotationally coupled to the housing about a first bore of the trigger;
  - a disconnector coupled to the trigger at a second bore of the trigger;
  - a hammer rotationally coupled to the housing at a first end; and
  - a sear operably engaging the disconnector and the hammer, and rotationally coupled to the housing;
  - wherein the trigger and disconnector are is dynamically balanced about the first bore.

13. The firearm of claim 12, wherein the trigger includes a cavity that receives a spring-loaded plunger that biases the disconnector into engagement with the sear.

14. The firearm of claim 12, wherein the disconnector includes a bore or recess configured to reduce a weight of the disconnector, and alter a position of a center of mass of the disconnector.

15. The firearm of claim 12, wherein the trigger includes a trigger shoe that extends away from the first bore, a tail member and a head member extending from the first bore in substantially opposite directions.

16. The firearm of claim 12, wherein the trigger is coupled to the housing by a trigger pin and the hammer is coupled to the housing by a hammer pin, and wherein the housing defines a recess configured to receive a spring that retains the hammer pin and the trigger pin.

17. The firearm of claim 16, wherein the recess includes a protrusion that biases the spring against the hammer pin and the trigger pin.

18. The firearm of claim 17, wherein the protrusion includes a lip that retains the spring in the recess.

19. The firearm of claim 12, wherein the housing includes a compressible bumper that is configured to prevent movement of the dynamically balanced trigger assembly when installed.

20. The firearm of claim 12, wherein the housing includes a bore configured to receive a hammer pin that couples the hammer to the housing, wherein the bore is non-circular.

21. The trigger system of claim 9, wherein the bumper comprises a pliable material and is disposed on an exterior surface of the housing, and is configured to preload the housing when installed in a receiver of a firearm to prevent relative movement between the housing and receiver.

22. The trigger system of claim 11, wherein the disconnector is configured to at least partially reside in a channel defined by the two legs of the sear.

23. The firearm of claim 12 wherein the sear is coupled to the housing by a sear pin that is received by a bore in the sear, wherein the sear comprises, a middle portion that comprises the bore, a neck portion that extends from a first side of the middle portion, two legs that extend from a second side of the middle portion, the second side being substantially opposite the first side, wherein the sear is substantially balanced about the bore in the sear.

24. The firearm of claim 23, wherein the disconnector is configured to at least partially reside in a channel defined by the two legs of the sear.

* * * * *